US008051573B1

(12) United States Patent
Stephan

(10) Patent No.: US 8,051,573 B1
(45) Date of Patent: Nov. 8, 2011

(54) USER MANIPULATED LINE MARKING APPARATUS

(76) Inventor: Frank Stephan, Westfield, IN (US)

( * ) Notice: Subject to any disclaimer, the term of this patent is extended or adjusted under 35 U.S.C. 154(b) by 0 days.

(21) Appl. No.: 12/803,655

(22) Filed: Jul. 1, 2010

Related U.S. Application Data

(60) Provisional application No. 61/270,515, filed on Jul. 9, 2009.

(51) Int. Cl.
*B43L 13/00* (2006.01)

(52) U.S. Cl. ..... 33/32.2; 33/32.1

(58) Field of Classification Search ..... 33/18.1, 33/32.1, 32.2, 32.3, 34, 40, 41.1
See application file for complete search history.

(56) References Cited

U.S. PATENT DOCUMENTS 1,895,754 A * 1/1933 Finkenwirth ..... 33/32.2
2,557,699 A * 6/1951 Silver ..... 33/18.1
2,655,728 A 10/1953 Cook
2,964,848 A * 12/1960 Gonsalves ..... 33/32.1
3,475,822 A 11/1969 Lain
3,626,595 A * 12/1971 Hulen ..... 33/32.2
4,189,844 A 2/1980 Riggins, Sr.
5,699,622 A 12/1997 Umbro
6,944,962 B2 9/2005 Tessel
2007/0240317 A1* 10/2007 Nicholson ..... 33/32.3
* cited by examiner

*Primary Examiner* — Brad Bennett
(74) *Attorney, Agent, or Firm* — Mark A. Navarre

(57) ABSTRACT

A user manipulated apparatus for producing straight construction lines on sheet material includes a linearly extensive frame with integrally formed handle and an expendable marking strip affixed to a bottom edge of the frame. A user positions the frame so that its ends are in registry with the endpoints of a desired construction line, with the marking strip contacting the surface of the sheet material. The user then linearly displaces the frame a short distance along its length so that the marking strip rubs along the surface of the sheet material and produces a visible construction line. The portion of the frame that supports the marking substance may be compliant to ensure that the marking substance fully engages the surface of the sheet material even when the sheet material has surface irregularities or is not perfectly planar.

14 Claims, 3 Drawing Sheets

USER MANIPULATED LINE MARKING APPARATUS

RELATED APPLICATIONS

This application claims priority based on the U.S. Provisional Patent Application Ser. No. 61/270,515, filed Jul. 9, 2009.

TECHNICAL FIELD

The present invention relates to a construction aid that marks or scribes a construction line on a sheet of material as a guide for cutting the material or fastening it to a support structure.

BACKGROUND OF THE INVENTION

Workers installing sheet material such as drywall, plywood, insulation, and moisture barrier wraps use tools or improvised devices for marking or scribing straight construction lines on the material to aid in its cutting or fastening to a support structure such as a stud, rafter or joist. The construction lines must be drawn accurately to minimize waste and ensure that the material will be properly fastened, and a good deal of time is often spent in repeatedly measuring and marking. Accordingly, what is needed is an improved and cost-effective line marking apparatus for quickly and accurately producing straight construction lines.

SUMMARY OF THE INVENTION

The present invention provides an improved apparatus for producing straight construction lines on sheet material, including a linearly extensive frame supporting a handle that is grasped by a worker and an expendable marking substance that engages the surface of the sheet material. In use, the worker positions the frame so that its ends are in registry with the endpoints of a desired construction line, and then linearly displaces the frame a short distance along its length so that the marking substance rubs along the surface of the sheet material and produces a visible construction line. The marking substance may be continuous for producing a continuous construction line, or intermittent for producing an intermittent construction line that guides fastener spacing. The portion of the frame that supports the marking substance may be compliant to ensure that the marking substance fully engages the surface of the sheet material even when the sheet material has surface irregularities or is not perfectly planar.

DESCRIPTION OF THE PREFERRED EMBODIMENT

Figure 2:
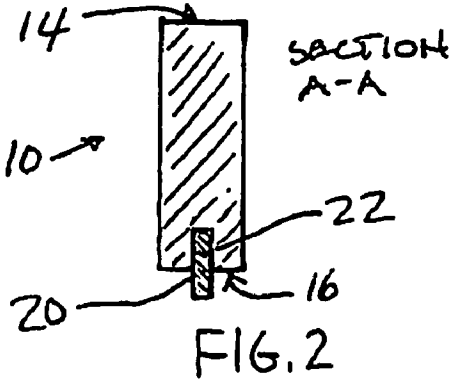
FIG. 2 is a cross-sectional view of the marking apparatus of FIG. 1, taken along the cut line A-A in FIG. 1.
Figure 1:
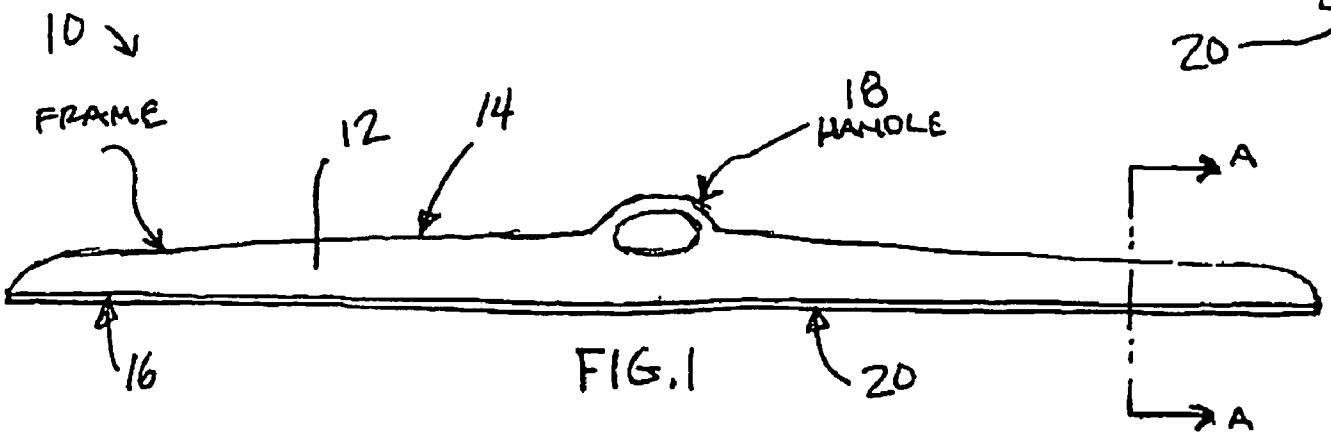
FIG. 1 is a side view of a marking apparatus according to a preferred embodiment of the present invention.
Figure 3:
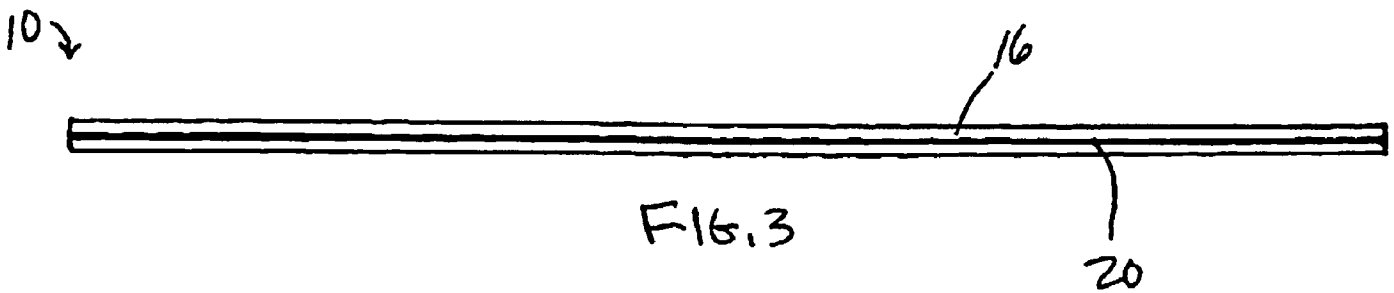
FIG. 3 is a bottom view of the marking apparatus of FIG. 1.

FIGS. 1-3 depict side, cross-sectional and bottom views of a marking apparatus generally designated by the reference numeral 10. Referring to FIGS. 1-3, the marking apparatus 10 comprises a linearly extensive frame 12 having top and bottom edges 14, 16, with a handle 18 integrally formed in a central portion of the top edge 14, and a marking strip 20 protruding from the bottom edge 16 along its length. As best seen in FIG. 2, the bottom edge 16 of frame 12 may be provided with an elongate slot 22 for receiving and securing the marking strip 20. Alternately, the marking strip 20 may be secured to the bottom edge 16 of frame 12 with a double-sided adhesive strip. The marking strip 20 preferably comprises a known expendable marking substance such as soft graphite (i.e., pencil lead), colored wax (i.e., crayon), charcoal or chalk, but may alternatively comprise a carrier (i.e., felt) that is saturated or impregnated with an expendable marking material such as ink, water, or acid. There are other possibilities as well. For example, the marking strip 20 may comprise a non-expendable material that scribes the sheet material, or a light-emitting material that emits laser or other light for marking light-sensitive sheet material.

In use, a construction worker grasps the marking apparatus 10 by the handle 18, and positions the frame 12 relative to a piece or section of sheet material such that the marking strip 20 engages the surface of the sheet material and the ends of frame 12 are in registry with the endpoints of a desired construction line. The construction worker uses the handle 18 to maintain the marking strip 20 in engagement with the surface of the sheet material, while at the same time, linearly displacing the frame 12 a short distance along its length. Due to the linear displacement of frame 12, the marking strip 20 rubs against the surface of the sheet material, leaving a visible mark on the surface of the sheet material in the process.

Figure 4:
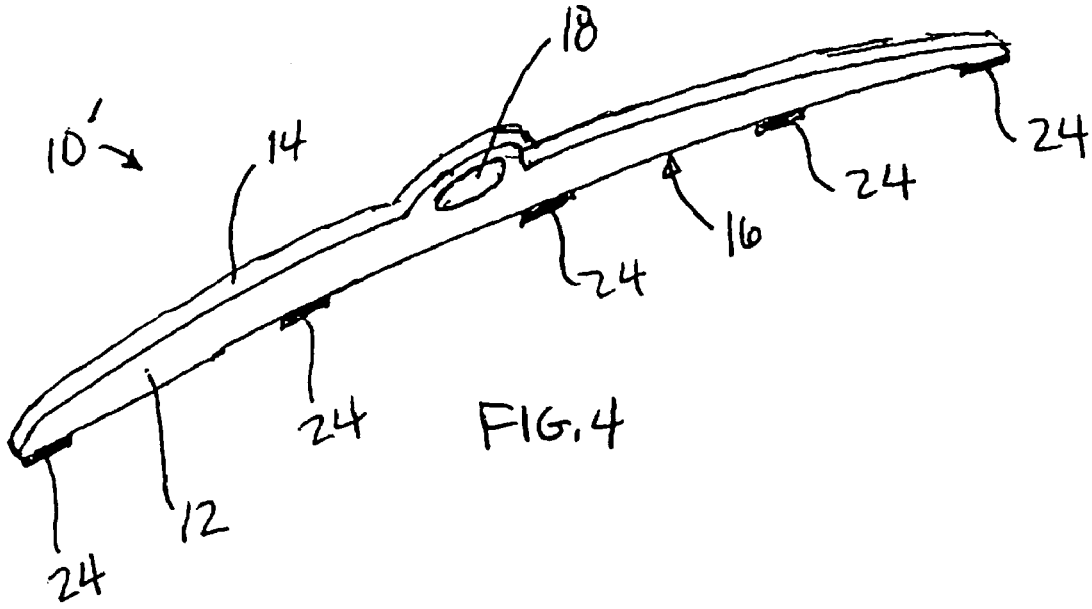
FIG. 4 is an isometric view of a marking apparatus according to a first alternate embodiment of the present invention.

Referring to FIG. 4, the reference numeral 10' designates a first alternate embodiment of the marking apparatus 10. Whereas the marking apparatus 10 of FIGS. 1-3 incorporates a marking strip 20 that extends continuously along the bottom edge 16 of frame 12, the marking strip of marking apparatus 10' comprises a number of spaced marking segments 24. When the frame 12 is positioned and linearly displaced as described above in respect to the embodiment of FIGS. 1-3, the marking segments 24 produce a number of individual spaced marks on the sheet material. This can be useful, for example, as a guide for equidistant placement of fasteners such as nails or screws. The marking segments 24 may be affixed to the frame 12 in the same manner as the marking strip 20 of FIGS. 1-3.

Figure 5:
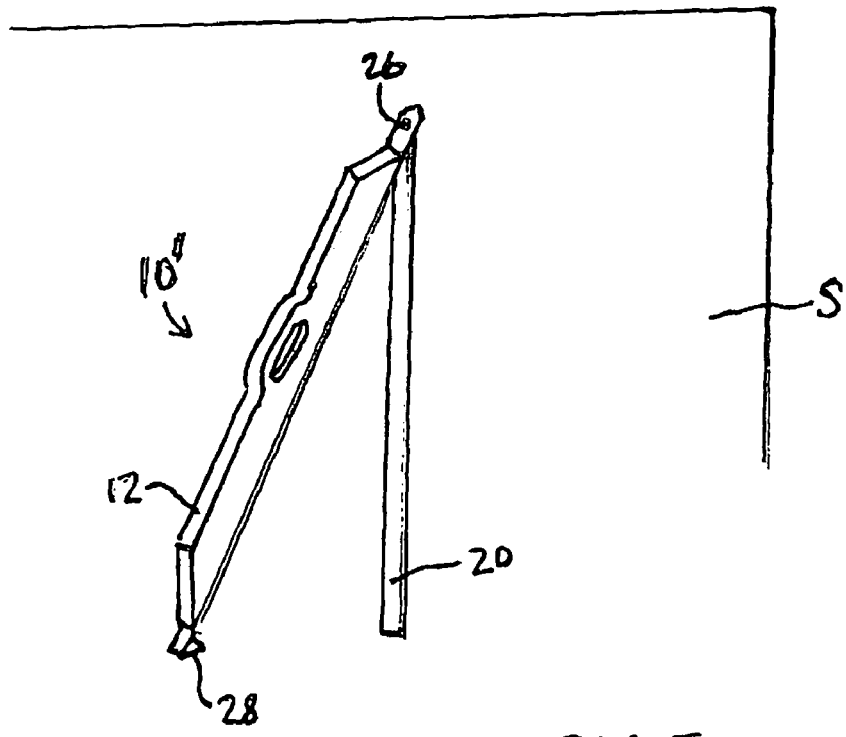
FIG. 5 is an isometric view of a marking apparatus according to a second alternate embodiment of the present invention.

Referring to FIG. 5, the reference numeral 10" designates a second alternate embodiment of the marking apparatus 10. In this embodiment, the frame includes two separate frame members 12*a* and 12*b*, fastened together at one end by a pin 26, and at the opposite end by a releasable clasp 28 affixed to frame member 12*a*. A marking strip 20 (not shown) is affixed to the outboard edge of frame member 12*b* as illustrated, for example, in FIG. 2. When the clasp 28 engages the frame member 12*b*, the frame members 12*a* and 12*b* move as one for use as described above with respect to the embodiments of FIGS. 1-3 and 4. However, when the clasp 28 is released (as shown in FIG. 5), the frame member 12*b* is free to rotate with respect to frame member 12*a* about pin 26. In this mode, the user positions frame member 12*a* so that pin 26 contacts the sheet material S at a point from which a vertical construction line is to be drawn downward, and allows frame member 12*b* to hang from the pin 26 to achieve vertical self-alignment. The user then rotates frame member 12*a* into alignment with frame member 12*b*, without moving frame member 12*b*, presses frame member 12*a* against frame member 12*b*, and linearly displaces the frame members 12*a* and 12*b* downward to form a vertical construction line on the sheet material S.

Figure 6:
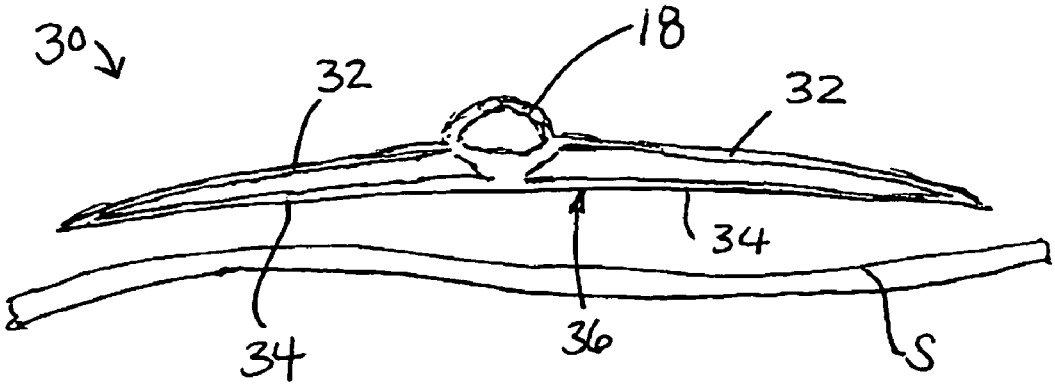
FIG. 6 is a side view of a marking apparatus according to a third alternate embodiment of the present invention.
Figure 7:
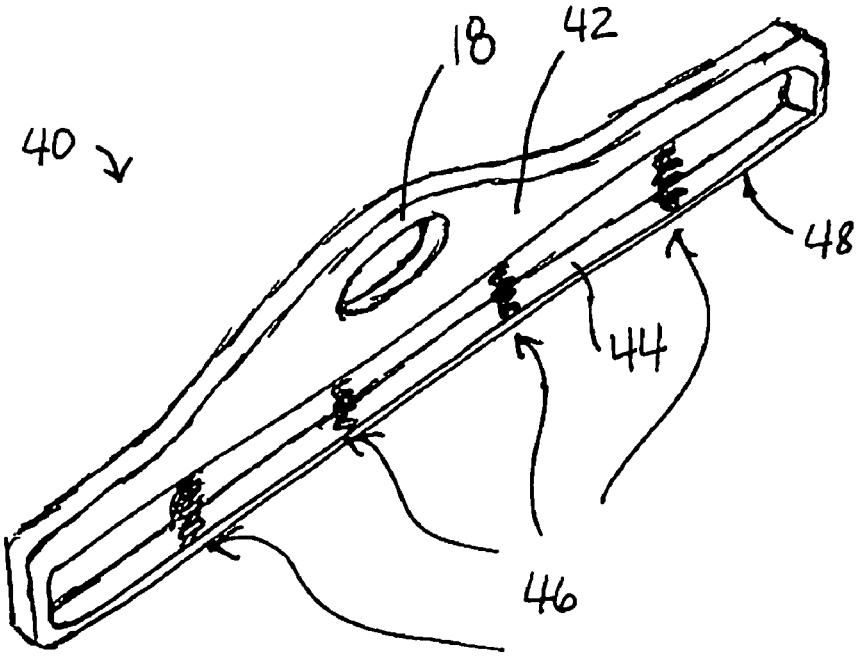
FIG. 7 is an isometric view of a marking apparatus according to a fourth alternate embodiment of the present invention.

In the embodiments of FIGS. 1-3, 4 and 5, frame 12 is planar, and generally rigid to define a planar bottom edge 16 to which the marking strip 20 or marking segments 24 are affixed. But in some cases, the sheet material S to be marked may be non-planar, making it difficult to maintain the marking strip 20 or marking segments 24 in engagement with the surface of the sheet material S. The second and third alternate embodiments of FIGS. 6 and 7 address this issue with a frame construction that gives its bottom edge 16 compliance sufficient to allow the marking strip 20 to fully engage the non-planar sheet material S. In the embodiment of FIG. 6, this is achieved with a frame 30 having upper and lower compliant members 32 and 34 joined at their ends, and joined in the middle by the integrally formed handle 18. A marking strip 20 (or marking strip segments 24) is affixed to the outboard edge 36 of the lower compliant member 34, and the members 32 and 34 flex when a user presses the frame 30 against the non-planar sheet material S to bring all or most of the marking strip 20 (or marking strip segments 24) into contact with the surface of the sheet material S. In the embodiment of FIG. 7, the frame compliance is achieved with a frame 40 having a generally rigid upper member 42 with integrally formed handle 18, a compliant lower member 44 joined at its ends to the upper member 42, and a set of linearly distributed springs 46 (or resilient substance) disposed between the rigid upper member 42 and the compliant lower member 44. A marking strip 20 (or marking strip segments 24) is affixed to the outboard edge 48 of the lower compliant member 44, and in this case, the springs 46 bias the marking strip 20 into engagement with the non-planar surface of the sheet material S when a user presses the frame 40 toward the sheet material S.

In any of the aforementioned embodiments, the frame of the marking device may be equipped with a bubble level to assist in producing horizontal or vertical construction lines, and/or locating features to assist in aligning the frame with the edge of a sheet of material. Also, the marking device may be produced in various sizes to suit different users and needs, or may be adjustable in length by telescopic or folding means.

While the present invention has been described with respect to the illustrated embodiments, it is recognized that numerous modifications and variations in addition to those mentioned herein will occur to those skilled in the art. For example, the marking strip 20 (or marking strip segments 24) may be affixed (by adhesive strip, for example) to an existing construction tool having a straight edge, such as a level or a T-square, in which case the existing construction tool takes the place of the illustrated frame 12. Additionally, the frame 12 and marking strip 20 may be constructed of the same material, if desired. Accordingly, it is intended that the invention not be limited to the disclosed embodiments, but that it have the full scope permitted by the language of the following claims.

The invention claimed is:

1. A user manipulated line marking apparatus for producing straight construction lines on sheet material, comprising:
- a linearly extensive frame having top and bottom edges; and
- a marking strip affixed to the bottom edge of the frame, said frame being positioned relative to the sheet material such that said marking strip contacts a surface of the sheet material, and rubs against said surface to produce a linear mark thereon when said frame is linearly displaced along its length.

2. The user manipulated line marking apparatus of claim 1, further comprising:
- a handle integrally formed in the frame proximate the top edge for user manipulation of the frame relative to the sheet material.

3. The user manipulated line marking apparatus of claim 1, where:
- said marking strip is non-expendable and scribes said surface to produce said linear mark.

4. The user manipulated line marking apparatus of claim 1, where:
- said marking strip is expendable.

5. The user manipulated line marking apparatus of claim 1, where said marking strip comprises:
- a carrier impregnated with an expendable marking material.

6. The user manipulated line marking apparatus of claim 1, where:
- said frame and said marking strip are constructed of the same material.

7. The user manipulated line marking apparatus of claim 1, further comprising:
- a slot in said bottom edge of said frame in which said marking strip is received.

8. The user manipulated line marking apparatus of claim 1, where:
- said marking strip comprises a series of spaced marking segments.

9. The user manipulated line marking apparatus of claim 1, where:
- said frame includes separate upper and lower members;
- said marking strip is affixed to an outboard edge of said lower member; and
- said upper and lower members are joined at a first end by a pin so that said lower member rotates freely with respect to said upper member about said pin and self-aligns vertically when said first end is positioned on said sheet material at a point from which a vertical linear mark is desired.

10. The user manipulated line marking apparatus of claim 9, further comprising:
- a releasable clasp for selectively joining second ends of said upper and lower members so that said upper and lower members move as one.

11. The user manipulated line marking apparatus of claim 1, where:
- said frame includes separate upper and lower members joined at their ends;
- said marking strip is affixed to an outboard edge of said lower member; and
- said lower member is compliant so that said marking strip conforms to irregularities in said sheet material.

12. The user manipulated line marking apparatus of claim 11, further comprising:
- a handle integrally formed in said frame proximate said top edge for user manipulation of said frame relative to said sheet material, said upper and lower members being joined proximate to said handle.

13. The user manipulated line marking apparatus of claim 11, where:
- said upper member is rigid, and a resilient member is disposed between said rigid upper member and said compliant lower member.

14. The user manipulated line marking apparatus of claim 13, where:
- said resilient member includes a series of spaced springs.

* * * * *